United States Patent [19]

McFadden

[11] 4,361,940

[45] Dec. 7, 1982

[54] SLIP-TYPE ELEVATOR LOCKING MECHANISM

[75] Inventor: Edward J. McFadden, Houston, Tex.

[73] Assignee: BJ-Hughes Inc., Houston, Tex.

[21] Appl. No.: 289,945

[22] Filed: Aug. 4, 1981

[51] Int. Cl.[3] ..... F16L 33/10

[52] U.S. Cl. ..... 24/263 DA; 24/263 R; 24/263 D

[58] Field of Search ..... 24/263 DA, 263 CA, 263 R, 24/263 D, 115 G; 285/144–148

[56] References Cited

U.S. PATENT DOCUMENTS

| | | | |
|---|---|---|---|
| 1,356,458 | 10/1920 | Moody | 24/263 R |
| 1,847,087 | 3/1932 | Greve | 24/263 CA |
| 2,545,627 | 3/1951 | Moore | 24/263 DA |
| 2,564,119 | 8/1951 | Mathews et al. | 24/263 DA |

OTHER PUBLICATIONS

BJ-Hughes, Inc., "Replacement Parts Manual for Slip Type Elevator Spider", p. 12.

*Primary Examiner*—Gene Mancene
*Assistant Examiner*—John Weiss
*Attorney, Agent, or Firm*—Robert A. Felsman; Charles D. Gunter, Jr.

[57] ABSTRACT

An improved slip-type elevator locking mechanism has a lock rod which has one end connected to the slip setting yoke and a free end extending generally parallel with the direction of movement of the slips in the elevator bowl. A cam arm mounted on the elevator at a central pivot point has a cam throat on one end which is adapted to receive the lock rod free end and an opposite end and is pivotable about the central pivot point between upper and lower lock rod engaging positions and a neutral, unlocked position. A fluid cylinder is pivotally mounted by a base end to the elevator and is pivotally attached at its output shaft to the cam arm opposite end for urging the cam arm to the neutral position. The fluid cylinder output shaft is spring-biased outwardly away from the base end in the absence of fluid pressure on the cylinder. A yoke rod has one end connected to the slip-setting yoke and a free end extending in a direction generally parallel to the lock rod in a plane which intersects the plane of the cam arm opposite end. Upper and lower coil springs on the yoke rod urge the cam arm toward a select one of the upper and lower lock rod engaging positions when fluid pressure is lost.

17 Claims, 6 Drawing Figures

SLIP-TYPE ELEVATOR LOCKING MECHANISM

BACKGROUND OF THE INVENTION

The present invention relates generally to hoisting equipment of the type used on oil and gas derricks for raising and lowering pipe, casing, and tubing, and specifically to an improved slip-type elevator and locking mechanism therefor.

In a typical derrick arrangement, a traveling block is suspended from the derrick crown block by a series of cables which are driven by the derrick drawworks to raise and lower the traveling block along the vertical axis of the derrick. The usual derrick hook is suspended from the traveling block and supports a derrick elevator by means of links. The derrick elevator has a flat upper surface for supporting pipes to be raised or lowered, typically at an upset area of the pipe exterior such as a tool joint. In certain of the elevator designs, particularly the so-called elevator-spider, the elevator has a tapered interior "bowl" and a series of gripping dies or "slips" which are pivotally moved up and down within the bowl to grip the exterior surface of a pipe being handled.

In a typical operation in which casing is being run into a well bore, a pair of elevator-spiders are used in tandem. The lower elevator-spider rests on the derrick floor and supports the casing string in the well bore by means of its slips which are set to grip the casing exterior. A new joint of casing is raised into position over the well bore by means of an auxiliary elevator and the lower end of the casing joint is connected to the upper end of the casing string in the well bore. The upper elevator-spider is then stripped down over the top of the casing joint and the slips are set to grip the casing exterior. The upper elevator spider is then used to lift up the casing string which releases the slips of the lower elevator-spider and the casing string is lowered into the well bore. The slips of the lower elevator-spider are then set to support the casing string in the well bore and the upper elevator-spider is disengaged and stripped up and off the casing to allow another casing joint to be moved into position. This cycle is repeated until all the casing is run into the well bore.

Slip-type elevators generally have slips which are pivotally operable between a "slips-up" position and a "slips-down" or set position for gripping the pipe exterior. The slips are moved between the up and down positions by means of a fluid cylinder arrangement. In a typical arrangement, a yoke is connected to the slips by suitable linkages. The output shafts of a pair of fluid cylinders are connected on one side of the yoke with the opposite side of the yoke being connected to the slip linkages. The yoke pivots about a pivotal axis in the approximate center of the yoke when fluid pressure is applied to the cylinders. During normal raising or lowering of the slips, the fluid cylinders serve to retain the slips in the raised or lowered position. The rate of raising or lowering of the slips can be controlled by providing an adjustable air flow valve or valves in the air distribution system leading to the fluid cylinders.

Because of the great weight of the pipe, casing, and tubing which is raised and lowered on the derrick and the danger to rig personnel, there exists a need for a locking mechanism which will lock the slips in the event of a loss of fluid pressure. Prior locking mechanisms were manually operated by rig personnel. Because the mechanisms did not operate automatically upon loss of fluid pressure, operator dilligence was required to insure that the slips did not open or set prematurely. Elimination of this human factor would increase safety and reliability of the elevator operation.

SUMMARY OF THE INVENTION

The present locking mechanism for a slip-type elevator of the type having a series of slips in a tapered bowl and a slip-setting yoke for pivotally setting the slips has a housing for mounting on the elevator. A lock rod has one end which is adapted to be connected to the slip setting yoke and has a free end which extends in a direction generally parallel with the direction of movement of the slips in the bowl and which extends in the plane of the housing. A cam arm is mounted on the housing at a central pivot point. The cam arm has a cam throat on one end adapted to receive the lock rod free end. The cam arm is pivotable about the central pivot point between upper and lower lock rod engaging positions and a neutral unlocked position. A biasing means having a base end and having an other end is pivotally mounted at the base end to the housing and pivotally attached at the other end to the cam arm opposite end for urging the cam arm to the neutral, unlocked position. A handle can be provided in the cam arm end opposite the biasing means pivot point for manually pivoting the cam arm about the central pivot point.

In the preferred embodiment, a fluid cylinder having a cylindrical base end and an output shaft is pivotally mounted at the base end to the housing and pivotally attached by the output shaft to the cam arm opposite end for urging the cam arm to the neutral unlocked position. The fluid cylinder output shaft is spring-biased outwardly away from the base end in the absence of fluid pressure on the cylinder. A yoke rod having one end connected to the slip-setting yoke has a free end extending in a direction generally parallel to the lock rod in a plane which intersects the plane of the cam arm opposite end. Tension means on the yoke rod urge the cam arm toward a select one of the upper and lower lock rod engaging positions when fluid pressure is lost in the fluid cylinder. By connecting the biasing cylinder pressure source to the slip fluid operating pressure, automatic locking is achieved in the event that fluid pressure is lost. In this event, the output shaft spring and the tension means on the yoke rod exert complimentary forces on the cam arm for urging the cam arm toward the appropriate upper and lower lock rod engaging positions.

DETAILED DESCRIPTION OF THE INVENTION

Figure 1:
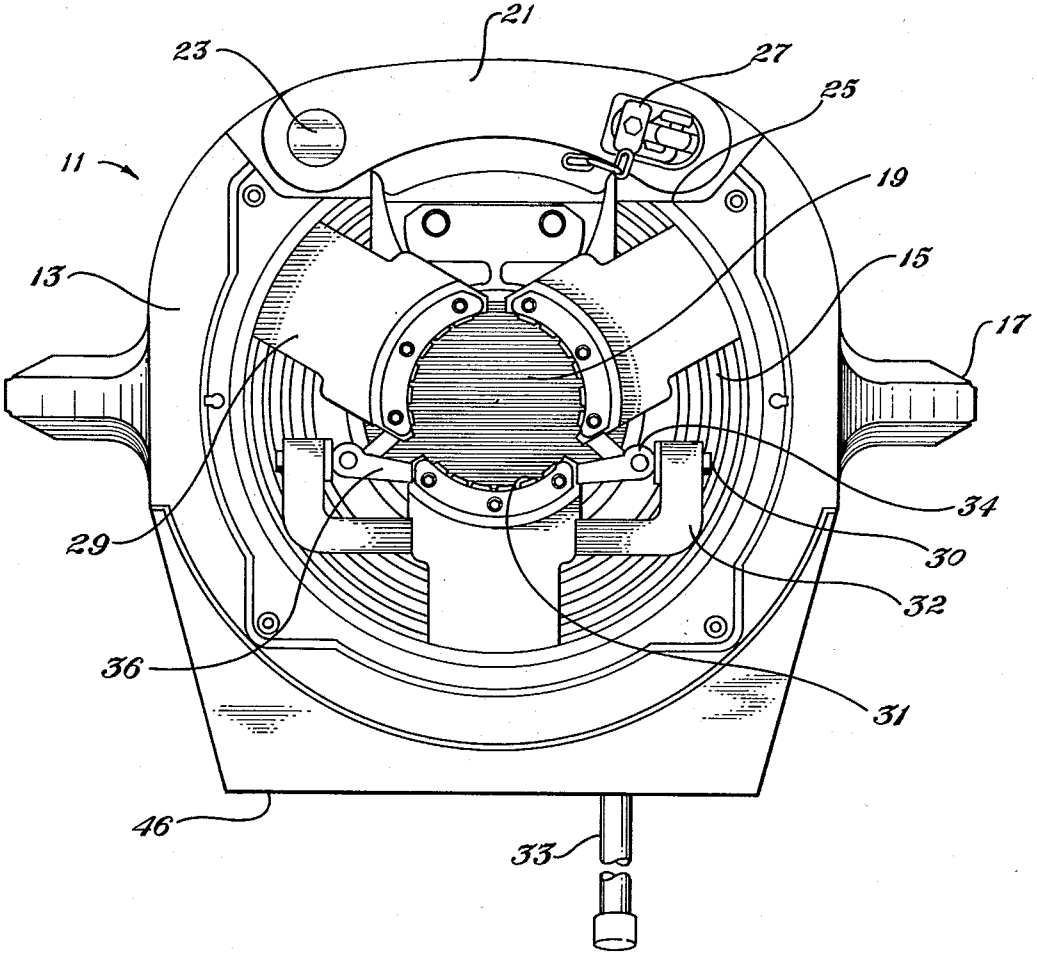
FIG. 1 is a top perspective view of the slip-type elevator of the invention.

Turning now to FIG. 1, there is shown an elevator designated generally as 11 having a cylindrical body 13 with a tapered interior bowl 15. A pair of ears 17 are provided for receiving the links running from the derrick hook in order to raise and lower the elevator 11 in the derrick. A central bore 19 is provided for receiving a section of pipe, casing, or tubing to be raised or lowered. Radical access to bore 19 is provided by a side gate 21 which pivots about a point 23 on one side of a gate opening 25 and which is secured by means of a latch mechanism 27 on the opposite side of opening 25. Three matching gripping dies or slips 29 are shown seated in the tapered interior bowl 15. The slip faces 31 are equi-distantly spaced in circumferential fashion about the vertical axis passing through the center of bore 19.

Figure 2:
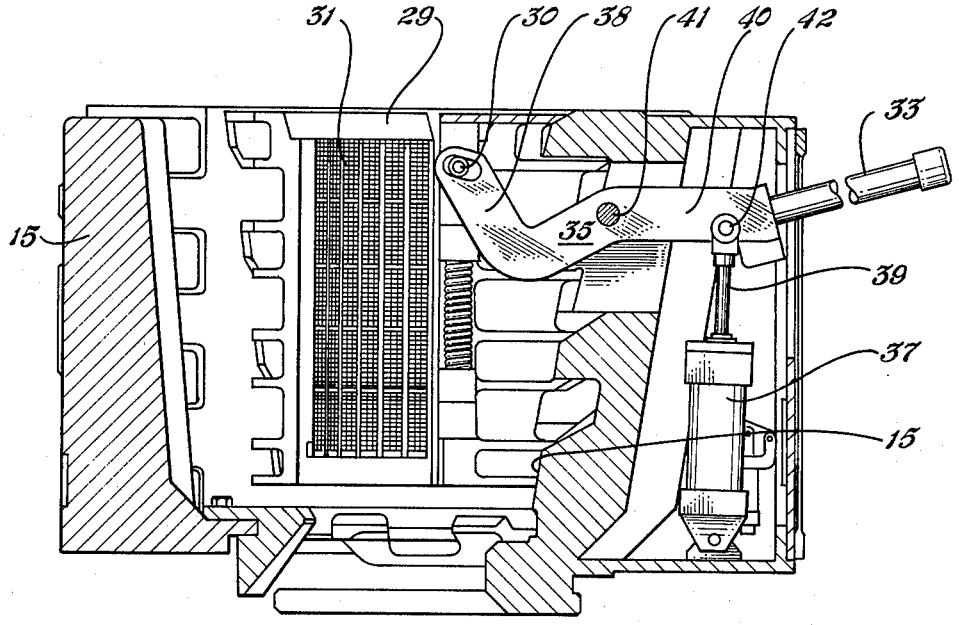
FIG. 2 is a side view of the elevator of FIG. 1, partially in section, showing operation of the slips.

Each of the slips 29 is connected for pivotal movement by means of pins 30 and linkages 32, 34, and 36 to the front side 38 of a yoke 35. As shown in FIG. 2, a pair of identical double acting fluid cylinders 37 are mounted on the exterior of bowl 15 and have output shafts 39 which are connected at pivot points 42 to the back side 40 of yoke 35 opposite linkages 32. Yoke 35 pivots about a pivotal axis drawn through pivot points 41 the approximate center of yoke 35 to move the slips 29 between the set or "slips-down" position shown in FIG'S. 1 and 2 when the cylinder shafts 39 are extended and a raised or "slips-up" position when cylinder shafts 39 are retracted in the fluid cylinders 39. During normal raising and lowering of the slips 29, the cylinder output shafts 39 serve to retain the slips in the raised or lowered position. Should the fluid pressure on cylinders 37 be inadvertently lost, the slips could fail to grip a pipe properly or prematurely set to grip a pipe which was being raised or lowered. A handle 33 is provided for manually raising and lowering the slips.

Figure 3:
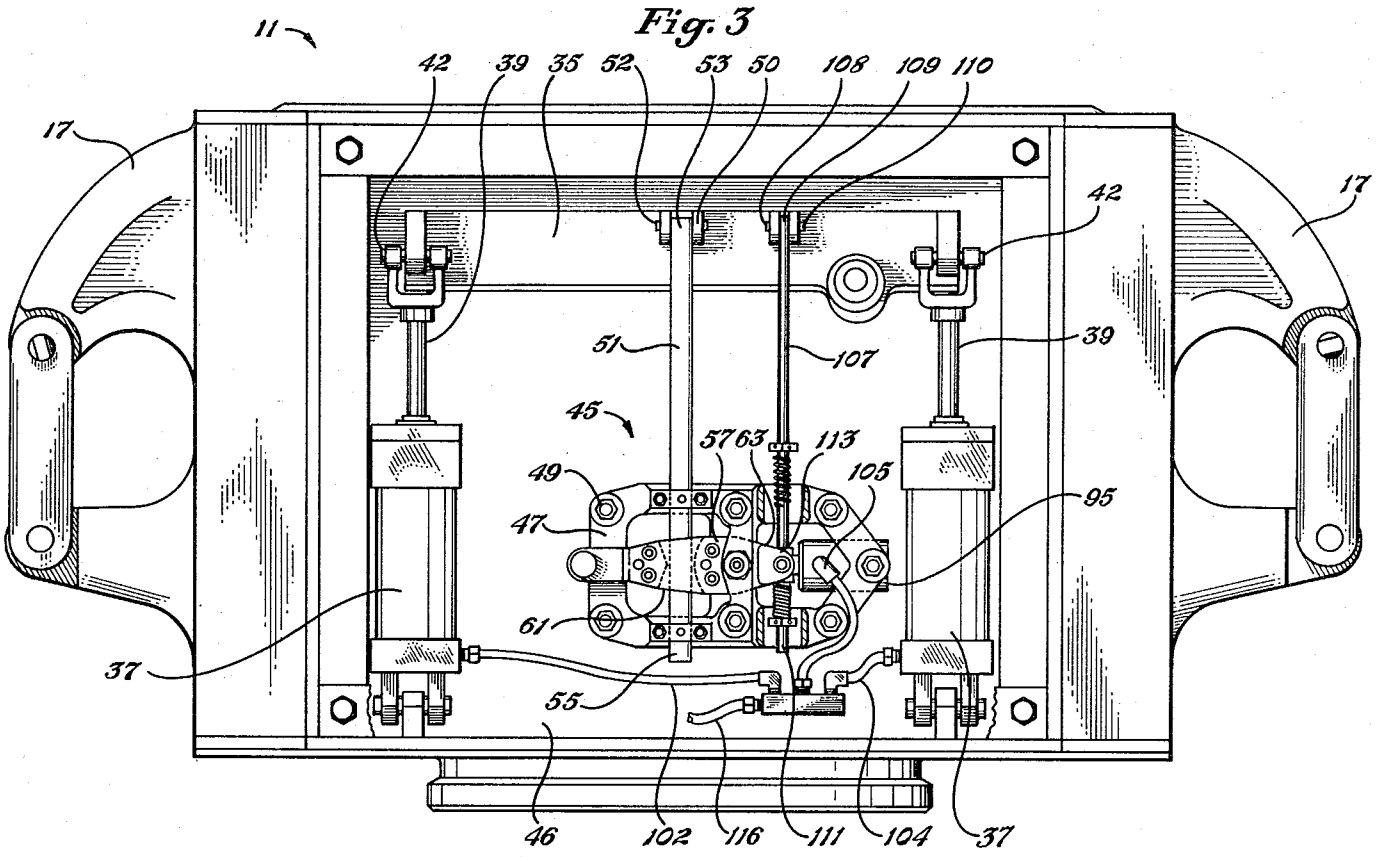
FIG. 3 is a back perspective view of the elevator of FIG. 1 partially broken away to show the locking mechanism in place.

FIG. 3 is a back view of elevator 11 showing the locking mechanism 45 of the invention in place on the elevator exterior 46 opposite gate 21. The locking mechanism 45 includes a housing 47 for mounting on the elevator as by bolts 49. A lock rod 51 has an end 53 adapted to be connected to the slip setting yoke 35 as by clevice 50 and pin 52 and has a free end 55 extending in a direction generally parallel with the direction of movement of slips 29 along the vertical axis of bore 19, and in the plane of housing 47.

Figure 4:
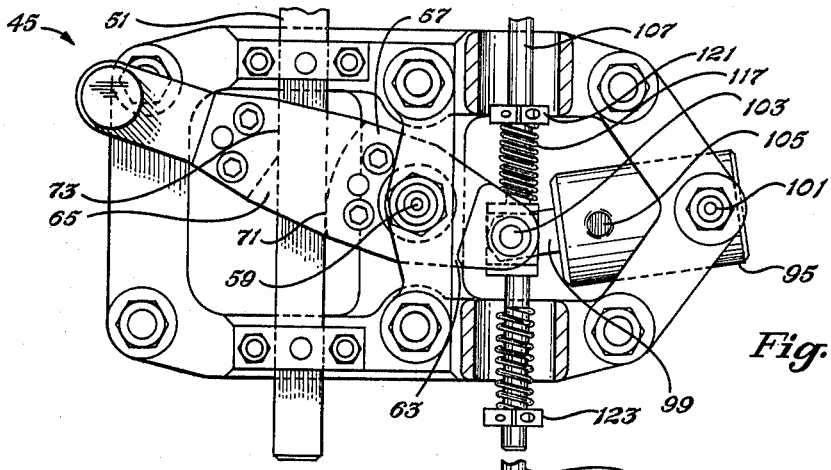
FIG. 4 is a close-up view of the locking mechanism of FIG. 3 in the "slips-up" position.
Figure 5:
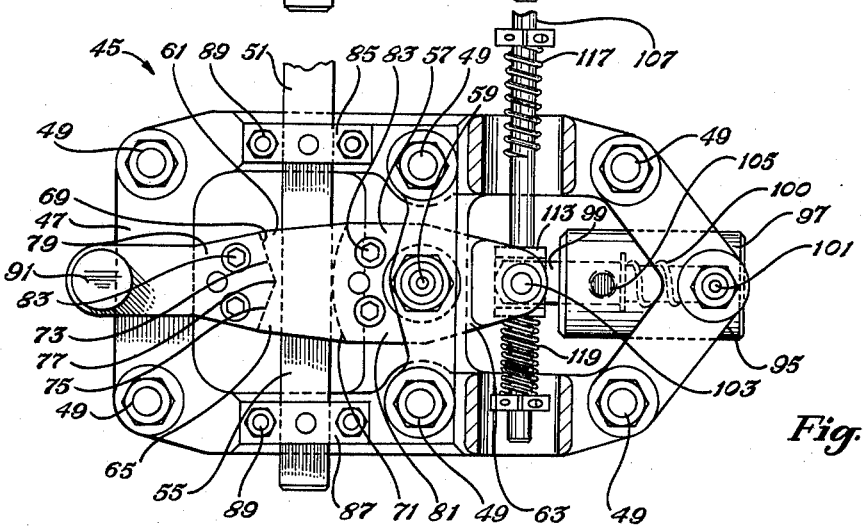
FIG. 5 is a close-up view of the locking mechanism of FIG. 3 in the "neutral" position.
Figure 6:
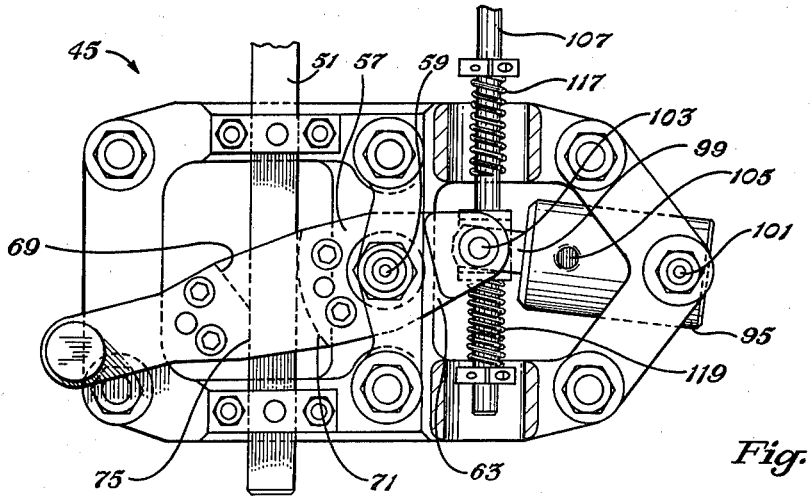
FIG. 6 is a close-up view of the locking mechanism of FIG. 3 in the "slips-down" position.

The locking mechanism 45 is shown in greater detail in FIG. 5. A cam arm 57 is mounted on the housing 47 at a central pivot point 59. Cam arm 57 has a cam throat 61 on one end adapted to receive the lock rod free end 55 and having an opposite end 63. The cam arm 57 is pivotable about the central pivot point 59 between an upper rod engaging position as shown in FIG. 4, a neutral unlocked position as shown in FIG. 5, and a lower lock rod engaging position as shown in FIG. 6. Cam throat 61 comprises a slot 65 formed in the exterior surface of cam arm 57 and has opposing sidewalls 69, 71 which together define cam locking surfaces for securing the lock rod in the upper and lower positions shown in FIGS. 4 and 6. Sidewall 71 of slot 65 is a smoothly sloping convex surface while sidewall 69 has upper and lower extents 73, 75, respectively which meet at an apex 77. Slot 65 can be formed by replaceable inserts 79, 81 secured to the exterior surface of cam arm 57 by means of bolts 83. Lock rod 51 is maintained in vertical alignment in slot 65 by means of upper and lower brackets 85, 87 attached to housing 47 as by bolts 89.

A handle 91 can be provided in the cam arm 57 for manually pivoting the cam arm about pivot point 59. Biasing means, such as fluid cylinder 95 having a cylindrical base end 97 and an output shaft 99 is pivotally mounted at a point 101 to housing 47 and pivotally mounted at a point 103 by output shaft 99 to the cam arm opposite end 63 for urging the cam arm to the neutral unlocked position. The fluid cylinder output shaft 99 is spring-biased outwardly away from base end 97 by a coil spring 100 in the absence of fluid pressure supplied to fluid inlet 105 in cylinder 95.

As shown in FIG. 3, a yoke rod 107 is provided having one end 109 connected to the slip setting yoke 35 as by clevice 108 and pin 110 and having a free end 111 extending in a direction generally parallel to the lock rod 51 in a plane which intersects the plane of cam arm opposite end 63. A tension sleeve 113 is fixed to cam arm opposite end 63 at the output shaft pivot point 103. As shown in FIG. 5, tension sleeve 113 is adapted to slidably receive the lower portion 115 of yoke rod 107. Upper and lower coil springs 117, 119 are positioned on opposite sides of tension sleeve 113 for urging cam arm 57 toward a select one of the upper and lower lock rod engaging positions when fluid pressure is lost in fluid cylinder 95. Tension sleeve 113 and springs 117, 119 together comprise tension means for urging cam arm 57 toward the appropriate locking position in the event fluid pressure is lost. The source of fluid pressure connected to fluid inlet 105 of cylinder 95 is also connected to the slip fluid operating cylinders 37 by conduits 102, 104 (as shown in simplified form in FIG. 3) so that a loss in slip operating pressure also results in a loss of fluid pressure to cylinder 95.

The operation of the invention will now be described. During normal operation of the slips 29 between the up and down positions, the locking mechanism 45 is in the neutral or unlocked position as shown in FIGS. 3 and 5. In this position, lock rod 51 is free to slide up and down within brackets 85 and 87 and within cam throat 61 in cam arm 57. Fluid pressure from a conduit 116 which is supplied to cylinders 37 to pivot yoke 35 between the extended position shown in FIG. 3 and the retracted position is also supplied to fluid inlet 105 of cylinder 95. This fluid pressure overcomes the spring bias of shaft 99 causing shaft 99 to be retracted in cylinder 95 thereby aligning cam arm 57 so that pivot points 59, 103, and 101 are aligned.

Now assume that the elevator 11 is in position about a stand of pipe, casing, or tubing to be raised or lowered and the slips are in the "up" position with shafts 39 of fluid cylinders 37 fully retracted and the back side 40 of yoke 35 in its lowest position.

Fluid pressure supplied to one side of fluid cylinders 37 maintains shaft 39 in the retracted position and holds the slips up. If fluid pressure should be lost, shafts 39 would tend to extend to allow the slips to fall or set in the absence of a locking mechanism. However, as shown in FIG. 4, the coiled compression spring 100 inside fluid cylinder 95 forces shaft 99 outward in the absence of fluid pressure to inlet 105. Depending upon the position of the slips, coil springs 117, 119 urge cam arm opposite end 63 off center to the appropriate lock rod engaging positions to secure the slips. For instance, as shown in FIG. 4, the slips are in the "up" position with lock rod 51 and yoke rod 107 in their most downwardly extending positions. This causes coiled spring 117 to be compressed tending to urge pivot point 103 downwardly and off-center were it not for shaft 99 being urged inwardly by fluid pressure at inlet 105. When fluid pressure is lost, spring 117 urges pivot point 103 off center and compliments the action of shaft 99 which is spring-biased outwardly, thereby forcing cam arm opposite end 63 downwardly and wedging upper extent 73 of slot 65 and sidewall 71 against the lock rod 51.

If the slips are in the "down" or set position prior to loss of fluid pressure, coiled spring 119 is compressed tending to urge pivot point 103 upwardly. As shown in FIG. 6, loss of fluid pressure at inlet 105 allows coil spring 100 to push pivot point 103 off center and compliment the action of shaft 99 in pushing cam arm opposite end 63 upwardly to wedge lower extent 75 of sidewall 69 and sidewall 71 against lock rod 51. Yoke rod 107, springs 117, 119, and fluid cylinder 95 thus comprise indexing means for positioning cam arm 57 between the appropriate upper and lower lock rod engaging positions, depending upon the position of the slips 29.

Upper and lower collars 121, 123 on yoke rod 107 allow the tension in springs 117, 119 to be adjusted so that pivot point 103 is not off-centered over five degrees during normal operations when fluid pressure is present at inlet 105. Springs 117, 119 can thus be individually adjusted so that vertical movement of yoke rod 107 will not overcome the force retracting shaft 99, yet provide sufficient force to initially move pivot point 103 off-center in the event fluid pressure is lost.

By substituting a mechanical coiled compression spring assembly in place of fluid cylinder 95, the locking mechanism can be manually operated. The mechanism is then operated by manually moving or rotating the locking cam arm 57 either clockwise or counterclockwise about central pivot point 59 by using handle 91. During manual operation of the mechanism, yoke rod 107 and coiled springs 117 and 119 are not required.

An invention has been provided with significant advantages. The present locking mechanism does not depend upon the presence of fluid pressure to insure positive locking of the slips. The locking mechanism is inactive during normal operations but locks the slips in their existing position in the event fluid pressure is lost. Since the mechanism is activated by the loss of fluid pressure to the slip operating cylinders, it is not necessary to manually reset the mechanism each time the slips are moved between the up and down positions.

I claim:

1. A locking mechanism for a slip-type elevator of the type having a series of slips in a tapered bowl and a slip-setting yoke for pivotally setting said slips, comprising:

a housing for mounting on said elevator;

a lock rod having one end adapted to be connected to said slip-setting yoke and having a free end extending in a direction generally parallel with the direction of movement of said slips in said bowl and in the plane of said housing; and a cam arm mounted on said housing at a central pivot point, said cam arm having a cam throat on one end adapted to receive said lock rod free end, and wherein said cam arm is pivotable about said central pivot point between upper and lower lock rod engaging positions and a neutral, unlocked position.

2. A locking mechanism for a slip-type elevator of the type having a series of slips in a tapered bowl and a slip-setting yoke for pivotally setting said slips, comprising:

a housing for mounting on said elevator;

a lock rod having one end adapted to be connected to said slip-setting yoke and having a free end extending in a direction generally parallel with the direction of movement of said slips in said bowl and in the plane of said housing;

a cam arm mounted on said housing at a central pivot point, said cam arm having a cam throat on one end adapted to receive said lock rod free end and having an opposite end, and wherein said cam arm is pivotable about said central pivot point between upper and lower lock rod engaging positions and a neutral, unlocked position; and biasing means having a base end and having an other end pivotally mounted at said base end to said housing and pivotally attached at said other end to said cam arm opposite end for urging said cam arm to said neutral unlocked position.

3. A locking mechanism for a slip-type elevator of the type having a series of slips in a tapered bowl and a slip-setting yoke for pivotally setting said slips, comprising:

a housing for mounting on said elevator;

a lock rod having one end adapted to be connected to said slip setting yoke and having a free end extending in a direction generally parallel with the direction of movement of said slips in said bowl and in the plane of said housing;

a cam arm mounted on said housing at a central pivot point, said cam arm having a cam throat on one end adapted to received said lock rod free end and having an opposite end;

biasing means having a base end and having an other end pivotally mounted at said base end to said housing and pivotally attached at said other end thereof to said cam arm opposite end; and wherein said cam arm is pivotable about said central pivot point between a neutral, unlocked position in which said biasing means pivot points are aligned with said central pivot point, and upper and lower lock rod engaging positions in which said pivot points are out of alignment.

4. The locking mechanism of claim 3, wherein said cam throat comprises a slot formed in the exterior surface of said cam arm, said slot having opposite side walls which together define cam locking surfaces for securing said lock rod in said upper and lower positions.

5. The locking mechanism of claim 4, wherein a handle is provided in said cam arm end opposite said biasing means pivot point for manually pivoting said cam arm about said central pivot point.

6. A locking mechanism for a slip-type elevator of the type having a series of slips in a tapered bowl and a slip-setting yoke for pivotally setting said slips, comprising:

a housing for mounting on said elevator;

a lock rod having one end adapted to be connected to said slip-setting yoke and having a free end extending in a direction generally parallel with the direction of movement of said slips in said bowl and in the plane of said housing;

a cam arm mounted on said housing at a central pivot point, said cam arm having a cam throat on one end adapted to receive said lock rod free end and having an opposite end, and wherein said cam arm is pivotable about said central pivot point between upper and lower lock rod engaging positions and a neutral unlocked position; and a fluid cylinder having a cylindrical base end and an output shaft, said fluid cylinder being pivotally mounted at said base end to said housing and pivotally attached at said output shaft to said cam arm opposite end for urging said cam arm to said neutral, unlocked position.

7. The locking mechanism of claim 6, wherein said fluid cylinder output shaft is spring-biased outwardly away from said base end in the absence of fluid pressure on said cylinder.

8. An automatic locking mechanism for a slip-type elevator of the type having a series of fluid pressure operated slips in a tapered bowl and a slip-setting yoke for pivotally setting said slips, comprising:

a housing for mounting on said elevator;

a lock rod having one end adapted to be connected to said slip-setting yoke and having a free end extending in a direction generally parallel with the direction of movement of said slips in said bowl and in the plane of said housing;

a cam arm mounted on said housing at a central pivot point, said cam arm having a cam throat on one end adapted to receive said lock rod free end and having an opposite end, and wherein said cam arm is pivotable about said central pivot point between upper and lower lock rod engaging positions and a neutral, unlocked position; and a fluid cylinder having a cylindrical base end and an output shaft, said fluid cylinder being pivotally mounted at said base end to said housing and pivotally attached at said output shaft to said cam arm opposite end for urging said cam arm to said neutral, unlocked position;

a yoke rod having one end connected to said slip-setting yoke and having a free end extending in a direction generally parallel to said lock rod in a plane which intersects the plane of said cam arm opposite end; and tension means on said yoke rod for urging said cam arm toward a select one of said upper and lower lock rod engaging positions when fluid pressure is lost in said fluid cylinder.

9. The automatic locking mechanism of claim 8, wherein said fluid cylinder output shaft is spring-biased outwardly away from said base end in the absence of fluid pressure on said cylinder and wherein said output shaft spring and said tension means on said yoke rod exert complimentary forces on said cam arm for urging said cam arm toward a select one of said upper and lower lock rod engaging positions when fluid pressure is lost in said fluid cylinder.

10. An automatic locking mechanism for a slip-type elevator of the type having a series of fluid pressure operated slips in a tapered bowl and a slip-setting yoke for pivotally setting said slips, comprising:

a housing for mounting on said elevator;

a lock rod having one end adapted to be connected to said slip-setting yoke and having a free end extending in a direction generally parallel with the direction of movement of said slips in said bowl and in the plane of said housing;

a cam arm mounted on said housing at a central pivot point, said cam arm having a cam throat on one end adapted to receive said lock rod free end and having an opposite end, and wherein said cam arm is pivotable about said central pivot point between upper and lower lock rod engaging positions and a neutral, unlocked position; and a fluid cylinder having a cylindrical base end and an output shaft, said fluid cylinder being pivotally mounted at said base end to said housing and pivotally attached at said output shaft to said cam arm opposite end for urging said cam arm to said neutral unlocked position;

a yoke rod having one end connected to said slip-setting yoke and having a free end extending in a direction generally parallel to said lock rod;

a tension sleeve fixed to said cam arm opposite end at said output shaft pivot point, said tension sleeve being adapted to slidably receive said yoke rod free end; and coil springs positioned on opposite sides of said tension sleeve for urging said cam arm toward a select one of said upper and lower lock rod engaging positions when fluid pressure is lost in said fluid cylinder.

11. In a slip-type elevator of the type having a series of slips in a tapered bowl, a slip-setting yoke for pivotally setting said slips, and an improved locking mechanism for said slips, comprising:

a lock rod having one end connected to said slip-setting yoke and having a free end extending in a direction generally parallel with the direction of movement of said slips in said bowl; and a cam arm mounted on said elevator at a central pivot point, said cam arm having a cam throat on one end adapted to receive said lock rod free end, and wherein said cam arm is pivotable about said central pivot point between upper and lower lock rod engaging positions and a neutral, unlocked position.

12. In a slip type elevator of the type having a series of slips in a tapered bowl, a slip-setting yoke for pivotally setting said slips, and an improved locking mechanism for said slips comprising:

a lock rod having one end connected to said slip-setting yoke and having a free end extending in a direction generally parallel with the direction of movement of said slips in said bowl;

a cam arm mounted on said elevator at a central pivot point, said cam arm having a cam throat on one end adapted to receive said lock rod free end and having an opposite end, and wherein said cam arm is pivotable about said central pivot point between upper and lower lock rod engaging positions and a neutral, unlocked position; and biasing means having a base end and having an other end pivotally mounted at said base end to said elevator and pivotally attached at said other end to said cam arm opposite end for urging said cam arm to said neutral, unlocked position.

13. The slip-type elevator of claim 12, wherein said cam throat comprises a slot formed in the exterior surface of said cam arm, said slot having opposing side walls which together define cam locking surfaces for securing said lock rod in said upper and lower positions.

14. The slip-type elevator of claim 13, wherein a handle is provided in said cam arm end opposite said biasing means pivot point for manually pivoting said cam arm about said central pivot point.

15. In a slip-type elevator of the type having a series of slips in a tapered bowl, a slip-setting yoke for pivotally setting said slips, and an improved locking mechanism for said slips, comprising:

a lock rod having one end connected to said slip-setting yoke and having a free end extending in a direction generally parallel with the direction of movement of said slips in said bowl;

a cam arm mounted on said elevator at a central pivot point, said cam arm having a cam throat on one end adapted to receive said lock rod free end and having an opposite end, and wherein said cam arm is pivotable about said central pivot point between upper and lower lock rod engaging positions and a neutral, unlocked position; and a fluid cylinder having a cylindrical base end and an output shaft, said fluid cylinder being pivotally mounted at said base end to said elevator and pivotally attached at said output shaft to said cam arm opposite end for urging said cam arm to said neutral, unlocked position.

16. The slip-type elevator of claim 6, wherein said fluid cylinder output shaft is spring-biased outwardly away from said base end in the absence of fluid pressure on said cylinder.

17. In a slip-type elevator of the type having a series of fluid pressure operated slips in a tapered bowl and a slip-setting yoke for pivotally setting said slips and an improved locking mechanism for said slips, comprising:

a lock rod having one end connected to said slip-setting yoke and having a free end extending in a direction generally parallel with the direction of movement of said slips in said bowl;

a cam arm mounted on said elevator at a central pivot point, said cam arm having a cam throat on one end adapted to receive said lock rod free end and having an opposite end, and wherein said cam arm is pivotable about said central pivot point between upper and lower lock rod engaging positions and a neutral, unlocked position;

a fluid cylinder having a cylindrical base end and an output shaft, said fluid cylinder being pivotally mounted at said base end to said elevator and pivotally attached at said output shaft to said cam arm opposite end for urging said cam arm to said neutral, unlocked position;

a yoke rod having one end connected to said slip-setting yoke and having a free end extending in a direction generally parallel to said lock rod in a plane which intersects the plane of said cam arm opposite end; and tension means on said yoke rod for urging said cam arm toward a select one of said upper and lower lock rod engaging positions when fluid pressure is lost in said fluid cylinder.

* * * * *